US009957732B1

(12) United States Patent
Tomao et al.

(10) Patent No.: US 9,957,732 B1
(45) Date of Patent: May 1, 2018

(54) COMPRESSION LATCH

(71) Applicant: Whitecap Industries, Inc., Piscataway, NJ (US)

(72) Inventors: Christopher E. Tomao, Robbinsville, NJ (US); Du Sing-Long, Taipei (TW)

(73) Assignee: WHITECAP INDUSTRIES, INC., Piscataway, NJ (US)

( * ) Notice: Subject to any disclaimer, the term of this patent is extended or adjusted under 35 U.S.C. 154(b) by 0 days. days.

(21) Appl. No.: 15/719,759

(22) Filed: Sep. 29, 2017

(51) Int. Cl.

| | |
|---|---|
| ***E05B 13/10*** | (2006.01) |
| ***E05B 65/00*** | (2006.01) |
| ***B63B 19/24*** | (2006.01) |
| ***E05B 15/16*** | (2006.01) |
| ***E05C 3/00*** | (2006.01) |
| ***E05B 85/10*** | (2014.01) |

(52) U.S. Cl.
CPC ..... *E05B 13/10* (2013.01); *B63B 19/24* (2013.01); *E05B 15/16* (2013.01); *E05B 65/001* (2013.01); *E05B 85/103* (2013.01); *E05C 3/004* (2013.01)

(58) Field of Classification Search
CPC ..... E05B 13/10; E05B 85/103; E05B 65/00; E05B 15/16; E05B 13/002; E05C 3/004; B63B 19/24
USPC ..... 70/125–128, 207–210, 215, 221, 224, 70/461, 462, 475, 478, 484; 292/57–63, 292/66, 244, 336.3, DIG. 31, DIG. 60
See application file for complete search history.

(56) References Cited

U.S. PATENT DOCUMENTS

| | | | | |
|---|---|---|---|---|
| 4,510,779 | A * | 4/1985 | Ahad | E05B 5/00 292/DIG. 31 |
| 4,706,478 | A | 11/1987 | Swan et al. | |
| 5,526,660 | A | 6/1996 | Bennett et al. | |
| 6,039,363 | A * | 3/2000 | Sugimura | E05C 3/04 292/200 |
| 6,530,250 | B1 | 3/2003 | Linares et al. | |
| 6,953,209 | B2 * | 10/2005 | Jackson, Jr. | E05B 17/0025 16/412 |
| 7,454,933 | B1 | 11/2008 | Paige et al. | |
| 8,356,844 | B2 * | 1/2013 | Baic | E05B 41/00 292/205 |
| 8,915,105 | B2 | 12/2014 | Weinerman et al. | |

(Continued)

OTHER PUBLICATIONS

Southco Brochure, "N2 Compression Latch", Dec. 21, 2016, pp. 94-95.

*Primary Examiner* — Lloyd A Gall
(74) *Attorney, Agent, or Firm* — Servilla Whitney LLC

(57) ABSTRACT

A compression latch having a body including a cup having a well defining a first side of the compression latch, an exterior portion defining a second side opposite the first side, and a raised portion defining a peripheral rim surrounding the cup, the peripheral rim providing an uppermost surface of the cup is disclosed. The compression latch has a T-shaped handle mounted to the body, the T-shaped handle being foldable and reversible and having a cam lock mounted thereon, the cam lock having a keying element on one side of the handle and a rotatable locking cam on the second side of the handle, wherein when the T-shaped handle is folded in a first position, the keying element is exposed and does not protrude beyond the uppermost surface of the cup and when the T-shaped handle is reversed and folded in a second position, the rotatable locking cam is exposed and does no protrude beyond the uppermost surface of the cup.

20 Claims, 13 Drawing Sheets

(56) References Cited

U.S. PATENT DOCUMENTS

| | | | | |
|---|---|---|---|---|
| 2003/0121299 | A1* | 7/2003 | Graham | E05B 1/0092 70/208 |
| 2009/0256368 | A1 | 10/2009 | Thanh Le et al. | |
| 2013/0328328 | A1 | 12/2013 | Leslie et al. | |
| 2014/0331722 | A1 | 11/2014 | Bridgewater et al. | |

* cited by examiner

COMPRESSION LATCH

TECHNICAL FIELD

The present disclosure relates generally to compression latches, in particular compression latches that are used on vehicles such as boats to open, close, lock and unlock hatches and doors on cabinets, enclosures and compartments.

BACKGROUND

Compression latches are used in a variety of applications such as in securing cabinet and panel doors and hatches in a closed position. Compression latches typically include a shaft cam which is attached to a shaft and which is moved by a handle.

When used on boats, compression latches secure hatches and doors that cover openings in various compartments, cabinets and enclosures of the boat. A lock with a keying element such as a key allows the compression latch to be locked to restrict access to the compartment and secure the contents in the compartment. When the boat is not in use, the compression latch may be left in a locked state. The handle is typically D-shaped or T-shaped, and foldable between an extended position in which the handle can be grasped by a user to open a hatch or door to which the compression latch is assembled. In the locked state, the handle is folded down to expose a keying element, for example a keyhole, which allows the compression handle to be locked and unlocked by a key.

When the boat is used for fishing, a user of the boat will need to unlock one or more compression latches to permit access to some compartments, cabinets or enclosures, while other compartments may remain locked. Thus, as shown in FIGS. 1A and 1B, a compression latch 50 includes a foldable T-shaped handle 56. In FIGS. 1A and 1B, the handle 56 is in the extended position so that a user can grasp the handle to pull on the door or hatch to open the door or hatch. The handle 56 can be folded in the direction of arrow 40. When the compression latch 50 is in an unlocked position, allowing access to the compartment, a locking cam 58 is exposed, and there can be an issue with the locking cam 58 protruding outwardly from the a top surface 64 of the compression latch 50 when the T-shaped handle is folded down as discussed further below. The protruding locking cam 58 may snag or snare ropes and fishing line on the protruding component. The prior art compression latch 50 includes a main body 52, a shaft 53 extending from the main body 52 that connects the T-shaped handle 56 to a shaft cam 54. The locking cam 58 is on an underside 56*a* of the T-shaped handle 56, and the locking cam 58 can be locked and unlocked with a key 60 when the handle is in the folded position. A protruding lip 62 protrudes from an inner wall 63 of the main body 52, which acts as a catch to allow the locking cam 58 to be engaged beneath the protruding lip 62 to lock the compression latch 50. The main body 52 has an uppermost surface 64. The prior art compression latch 50 shown in FIG. 1A is configured such that when the handle is in the folded down or collapsed position with the locking cam 58 exposed, the underside 56*a* of the handle 56 is facing upward. The locking cam 58 extends beyond the uppermost surface 64 of the main body 52, and ropes and fishing lines can become caught on the locking cam 58 protruding past the uppermost surface 64, causing the ropes and fishing lines to become frayed and broken. On fishing boats, this can become particularly problematic, causing lost fishing time and lost opportunities to catch fish. For commercial fishing boats, this can lead to lost opportunity costs, and in fishing boats used in fishing tournaments, this can lead to losing a tournament.

Accordingly, there remains a need for improved compression latches that are simple in design, easy to assemble, reliable, low in cost, and resistant to water infiltration. In addition, it would be desirable that the compression handle does not have protruding parts that ensnare or snag ropes or fishing lines when the compression latch is in an unlocked position.

SUMMARY

One or more embodiments of the disclosure are directed to a compression latch comprising a body including a cup having a well defining a first side of the compression latch, an exterior portion defining a second side opposite the first side, and a raised portion defining a peripheral rim surrounding the cup, the peripheral rim providing an uppermost surface of the cup; a T-shaped handle that is foldable and reversible; a latch cam; a handle shaft that rotatably connects the T-shaped handle and the latch cam together, the handle shaft protruding through the well with a first end on the first side and a second end on the second side, the T-shaped handle mounted on the first end, and the latch cam mounted on the second end; and a cam lock mounted to the T-shaped handle including a base with a keying element connected to a rotatable locking cam that secures the T-shaped handle in a locked configuration when the locking cam is placed in a locked position, the T-shaped handle movable from a first movable folded position in which the keying element is exposed and flush with the uppermost surface of the cup to a second folded position in which the locking cam is exposed and flush with the uppermost surface of the cup.

A second embodiment pertains to a compression latch comprising a body including a cup having a well defining a first side of the compression latch, an exterior portion defining a second side opposite the first side, and a raised portion defining a peripheral rim surrounding the cup, the peripheral rim providing an uppermost surface of the cup; and a T-shaped handle mounted to the body, the T-shaped handle being foldable and reversible and having a cam lock mounted thereon, the cam lock having a keying element on one side of the handle and a rotatable locking cam on the second side of the handle, wherein when the T-shaped handle is folded in a first position, the keying element is exposed and does not protrude beyond the uppermost surface of the cup and when the T-shaped handle is reversed and folded in a second position, the rotatable locking cam is exposed and does not protrude beyond the uppermost surface of the cup. In one variant of the second embodiment, the well of the cup includes a peripheral sidewall including a cam lock-engaging sidewall having an undercut defining a groove that engages the locking cam when the cam lock is placed in the first position. In another variant of the second embodiment, the cam lock-engaging sidewall has a depth from the uppermost surface to a bottom of the well, and the T-shaped handle has a thickness between an inner surface of the cam lock and an outer surface of the T-shaped handle, the depth being greater than the thickness. In still another variant of the second embodiment, the depth of the cam lock-engaging sidewall permits the T-shaped handle to be pressed beneath the uppermost surface. In yet another variant of the second embodiment, the body further comprises a threaded extension extending from the peripheral rim away from the first side and a threaded nut to secure the compression latch to a hatch or a door.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
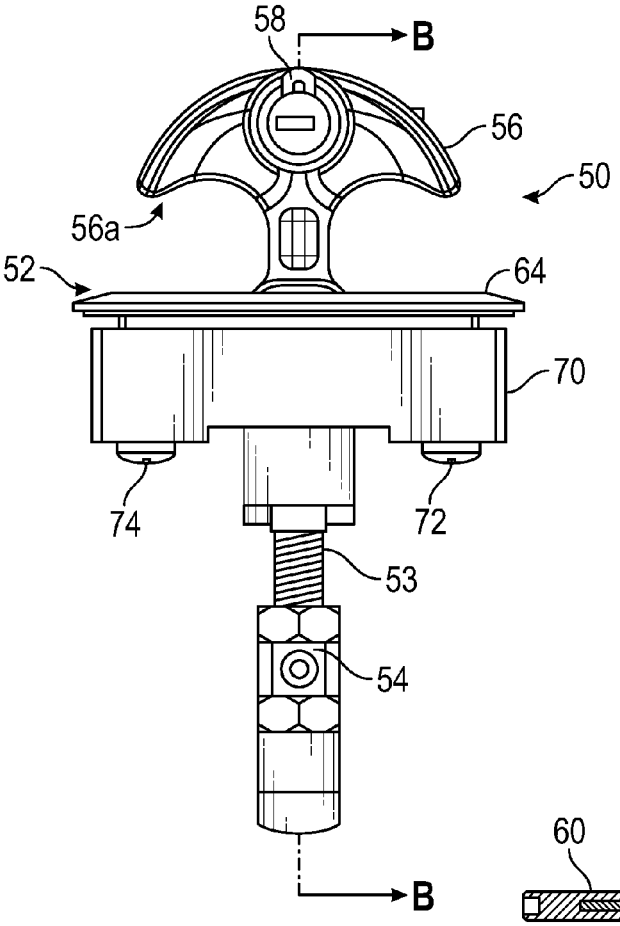
FIG. 1A (PRIOR ART)
FIG. 1A is a front isometric view of a prior art compression latch.
Figure 1B:
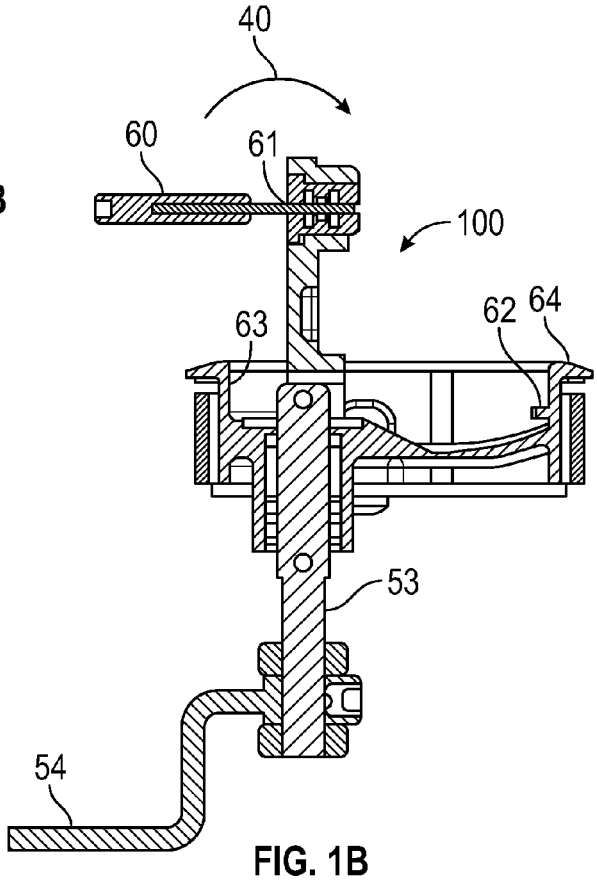
FIG. 1B (PRIOR ART)
FIG. 1B is a cross-sectional view taken along line B-B of FIG. 1A.

Before describing several exemplary embodiments of the disclosure, it is to be understood that the disclosure is not limited to the details of construction or process steps set forth in the following description. The disclosure is capable of other embodiments and of being practiced or being carried out in various ways.

The term "horizontal" as used herein is defined as a plane parallel to the plane or surface of a compression latch, regardless of its orientation. The term "vertical" refers to a direction perpendicular to the horizontal as just defined. Terms, such as "above", "below", "bottom", "top", "side" (as in "sidewall"), "higher", "lower", "upper", "over", and "under", are defined with respect to the horizontal plane, as shown in the figures.

The term "on" indicates that there is direct contact between elements. The term "directly on" indicates that there is direct contact between elements with no intervening elements.

Referring to FIGS. 2-15, an embodiment of a compression latch 100 is shown, comprising a body 102 including a cup 104 having a well 106 defining a first side 107 of the compression latch 100, an exterior portion 108 defining a second side 109 opposite the first side 107, and a raised portion defining a peripheral rim surrounding the cup 104, the peripheral rim 112 providing an uppermost surface 114 of the cup 104. The compression latch 100 further includes a T-shaped handle 116 that is foldable in the direction of arrow 120 and reversible. As used herein "T-shaped" refers to the handle having a shape that roughly corresponds to the letter "T." It will be understood however, that the T-shaped handle 116 may have a curved top portion 116*a* and a curved bottom portion 116*b*, and the T-shaped handle can be configured and shaped so that the handle is ergonomically designed so that a human hand can comfortably grab the handle to open and close doors to which the compression latch is attached or remove and replace hatches to which the compression latch is attached.

Figure 2:
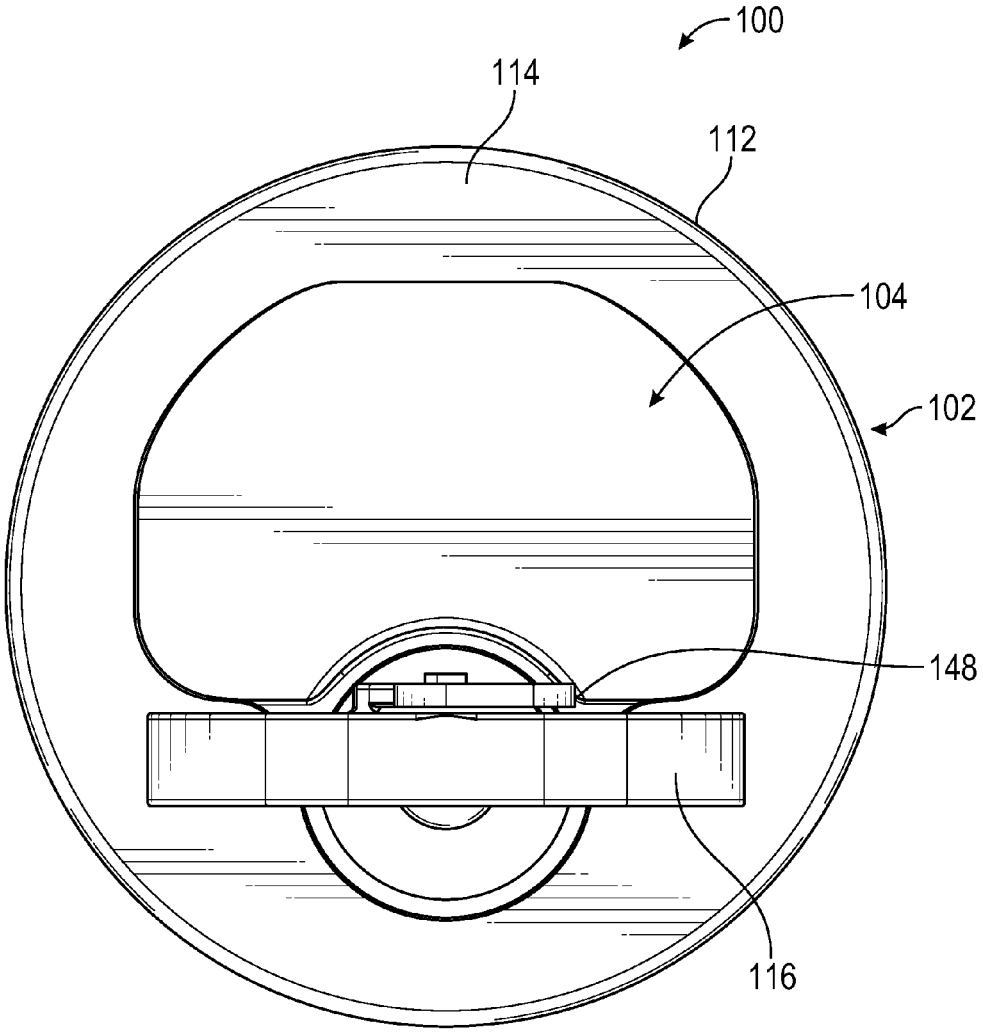
FIG. 2 is a top plan view of a compression latch in accordance with one embodiment.
Figure 3:
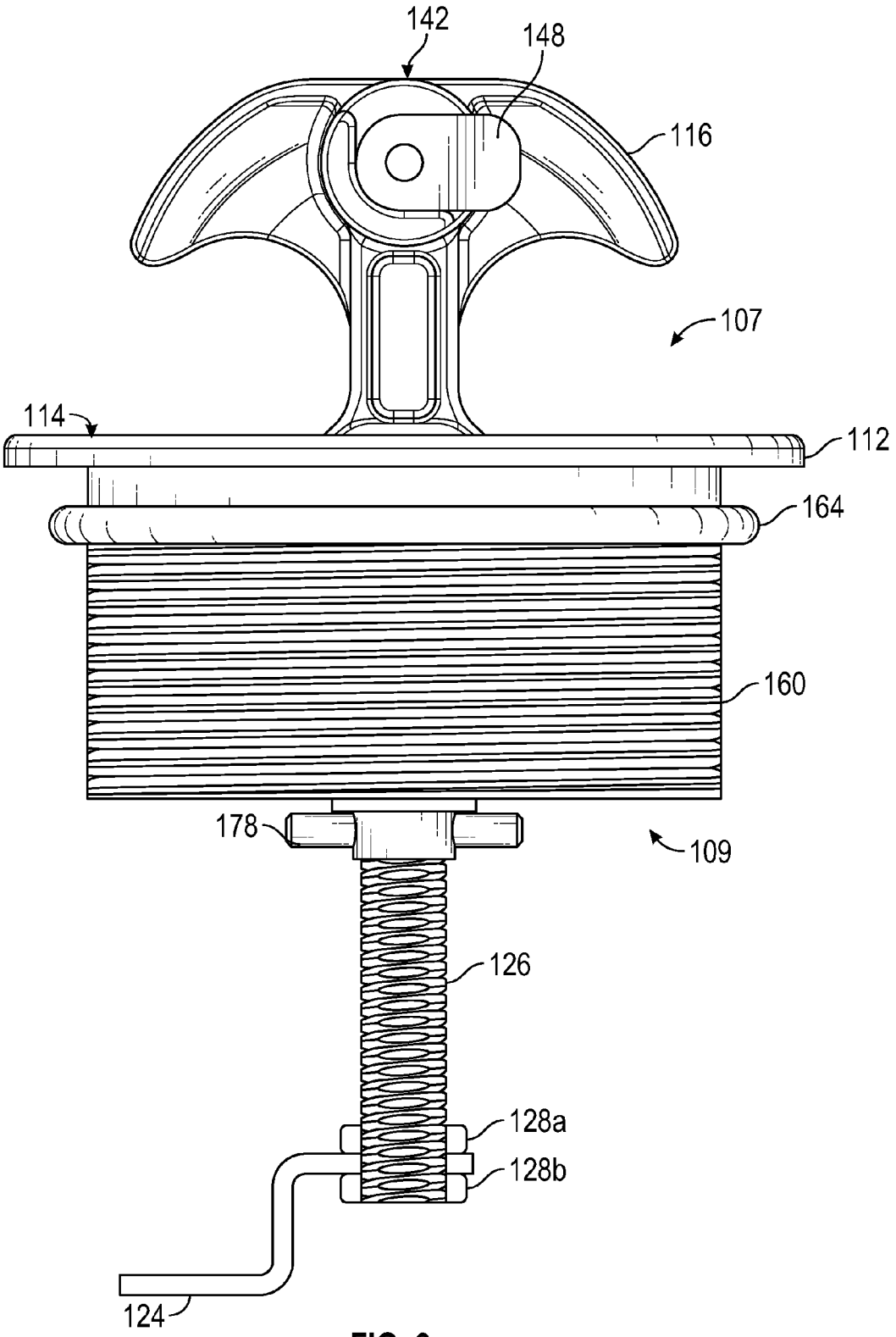
FIG. 3 is a front isometric view of an the compression latch of FIG. 2 compression latch.
Figure 4:
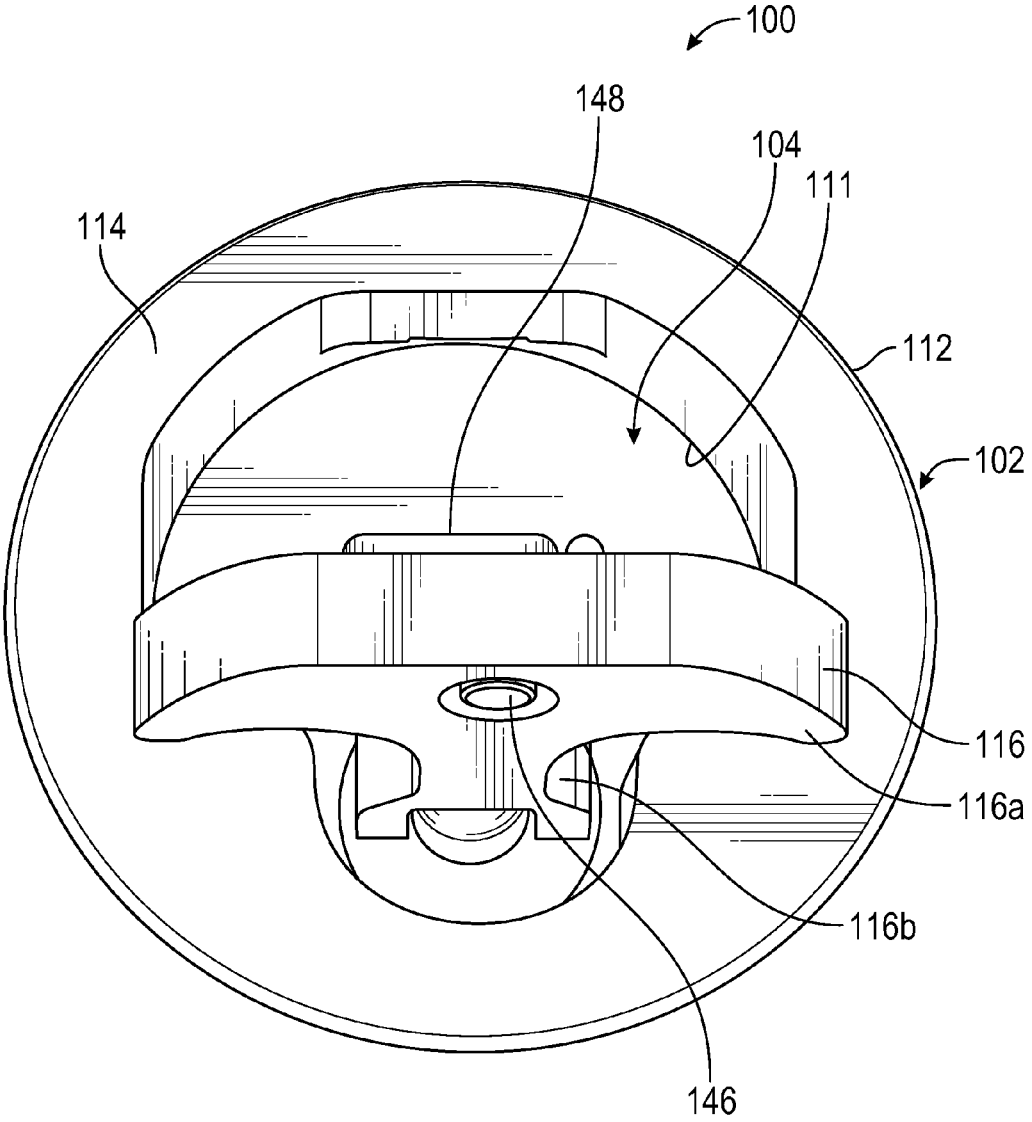
FIG. 4 is top perspective view of the compression latch of FIG. 3 showing the handle in a partially raised position.
Figure 5:
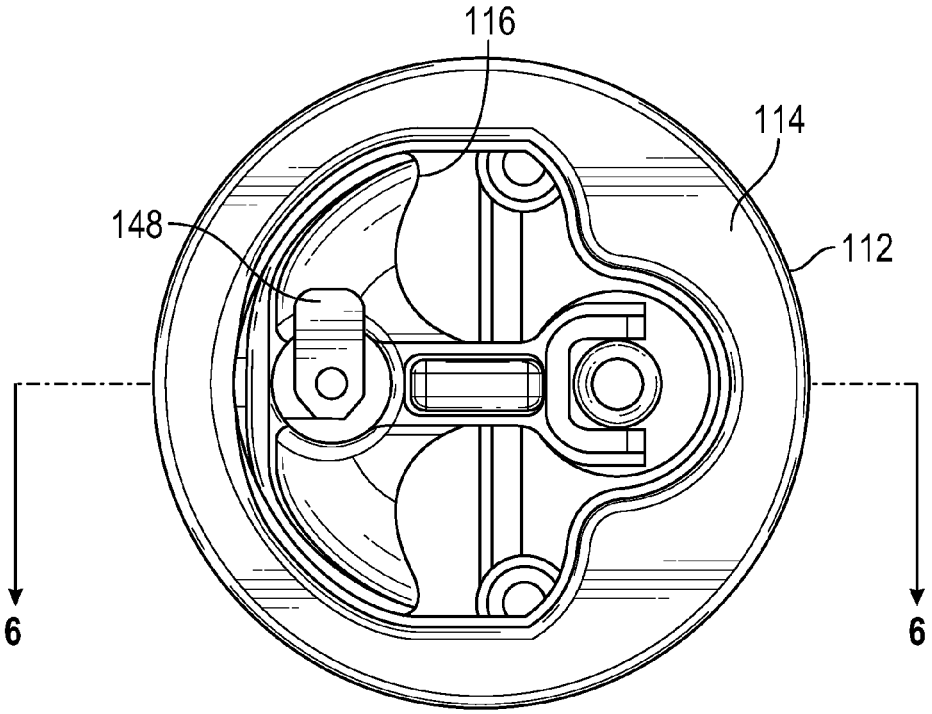
FIG. 5 is a top plan view of the compression latch of FIG. 3 showing the handle in a closed position with the locking exposed.
Figure 6:
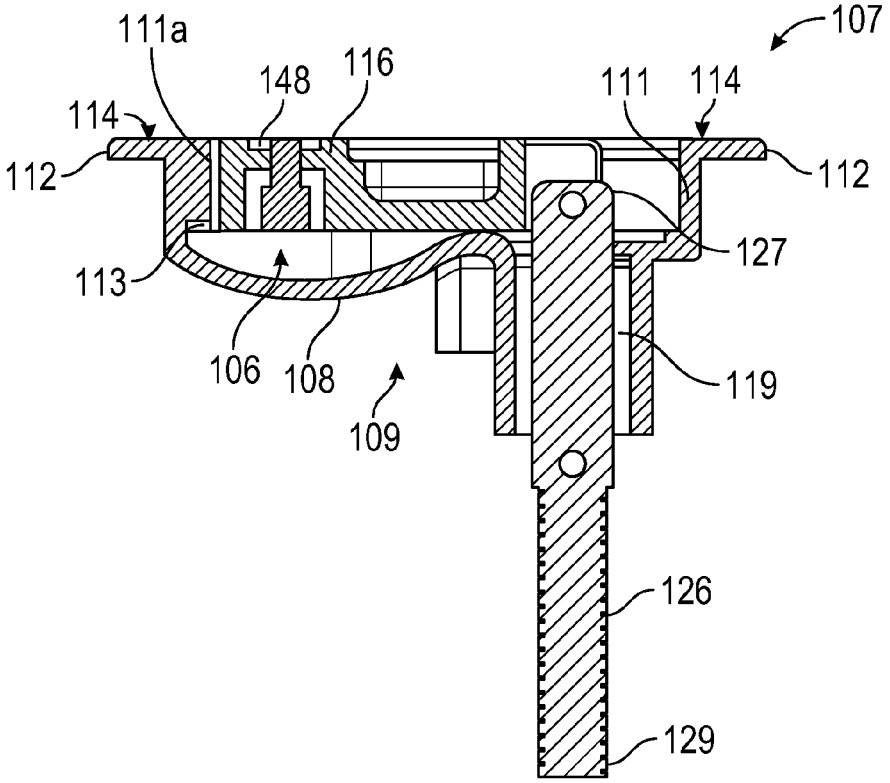
FIG. 6 is a cross-sectional view taken along line 6-6 of FIG. 5.

The compression latch can further include a latch cam 124 assembled to a handle shaft 126 by an appropriate fastener or fasteners such as first nut 128*a* and second nut 128*b*. The handle shaft 126 rotatably connects the T-shaped handle 116 and the latch cam 124 together, and the handle shaft 126 protrudes through the well 106 with a first end 127 on the first side 107 and a second end 129 on the second side 109. The T-shaped handle 116 is mounted on the first end 127, and the latch cam 124 is mounted on the second end 129. The T-shaped handle 116 is rotatable in the direction of arrow 130, and rotation in the direction of arrow 130 allows a user of the compression latch 100 to expose different sides of the handle when it is folded into the cup 104, which will be explained further below. The T-shaped handle 116 can also be pivotally moved from an upright position as shown in FIGS. 2-4 to a folded down position in which the T-shaped handle 116 is substantially contained within the well 106, as shown in FIGS. 5 and 6.

Figure 7:
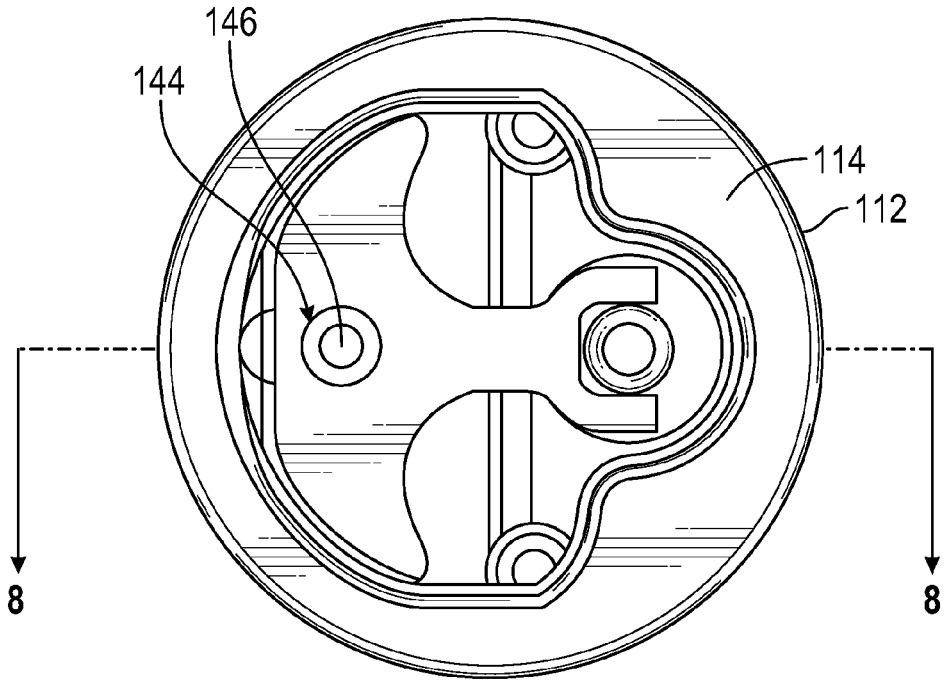
FIG. 7 is a top plan review of the compression latch of FIG. 3 showing the handle in a closed position, with the handle flipped from the orientation shown in FIG. 5 to expose the lock element.
Figure 8:
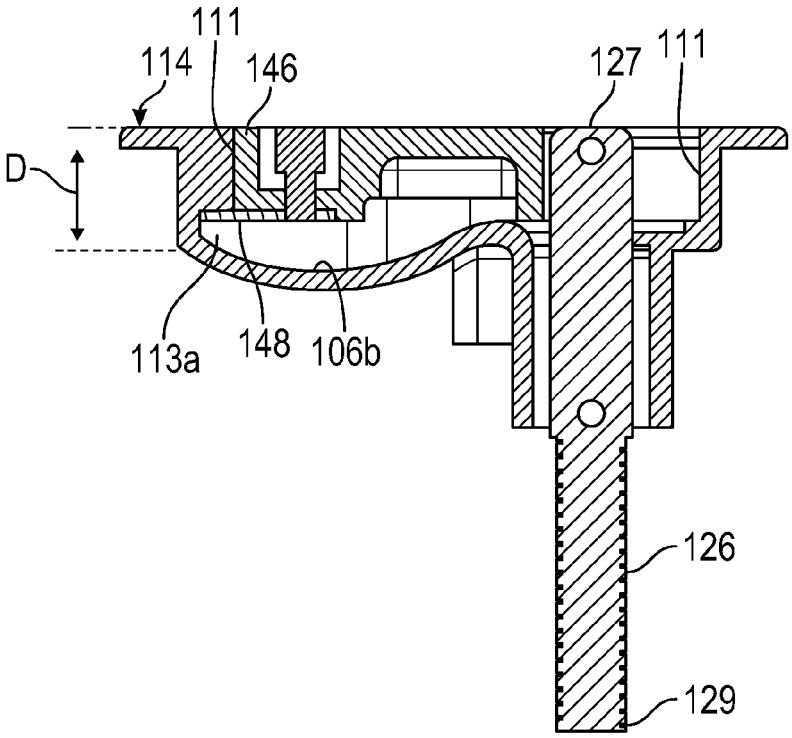
FIG. 8 is a cross-sectional view taken along line 8-8 of FIG. 7.
Figure 9:
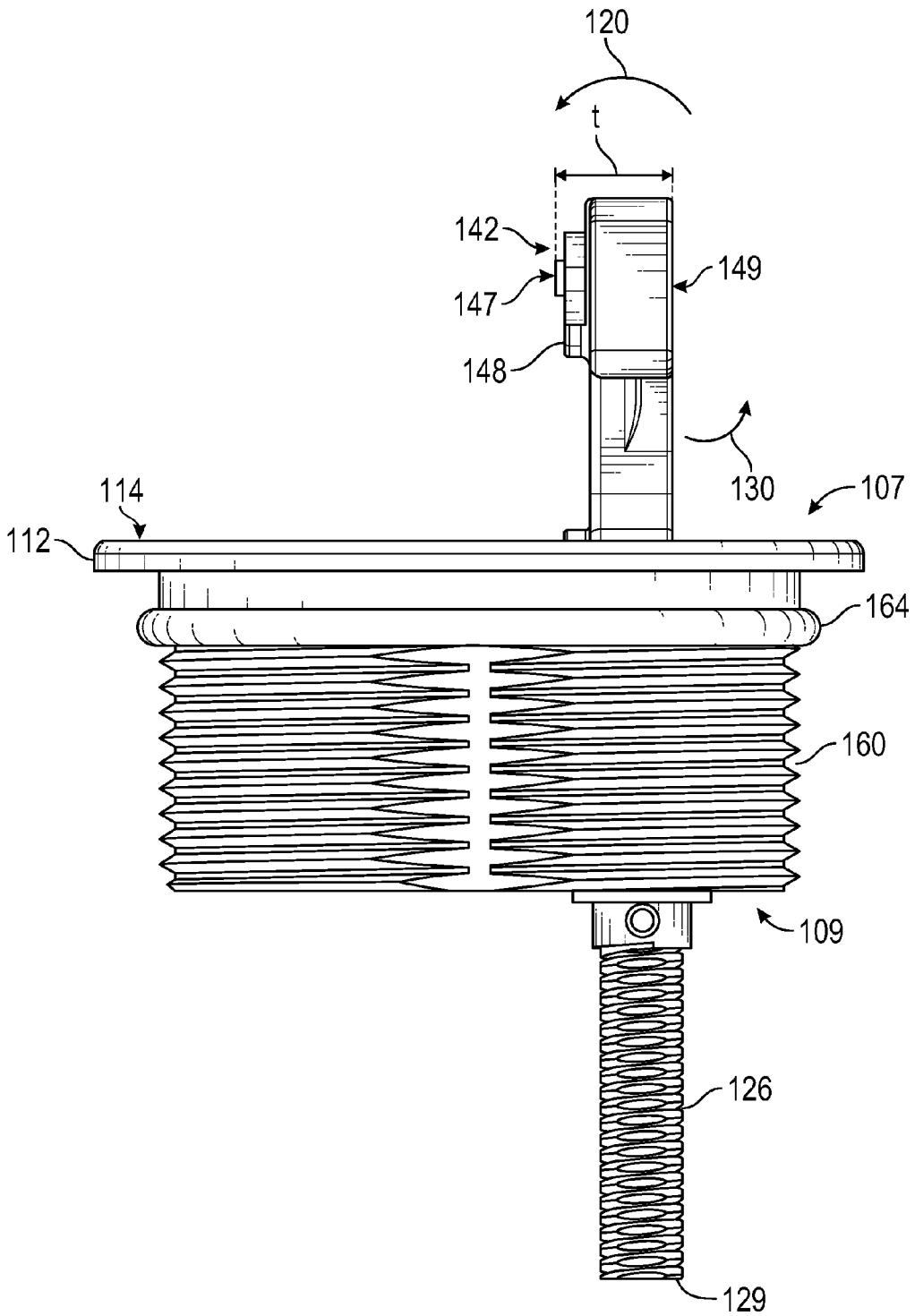
FIG. 9 is a side view of the compression latch shown in FIG. 3 with the handle in the raised position.
Figure 10:
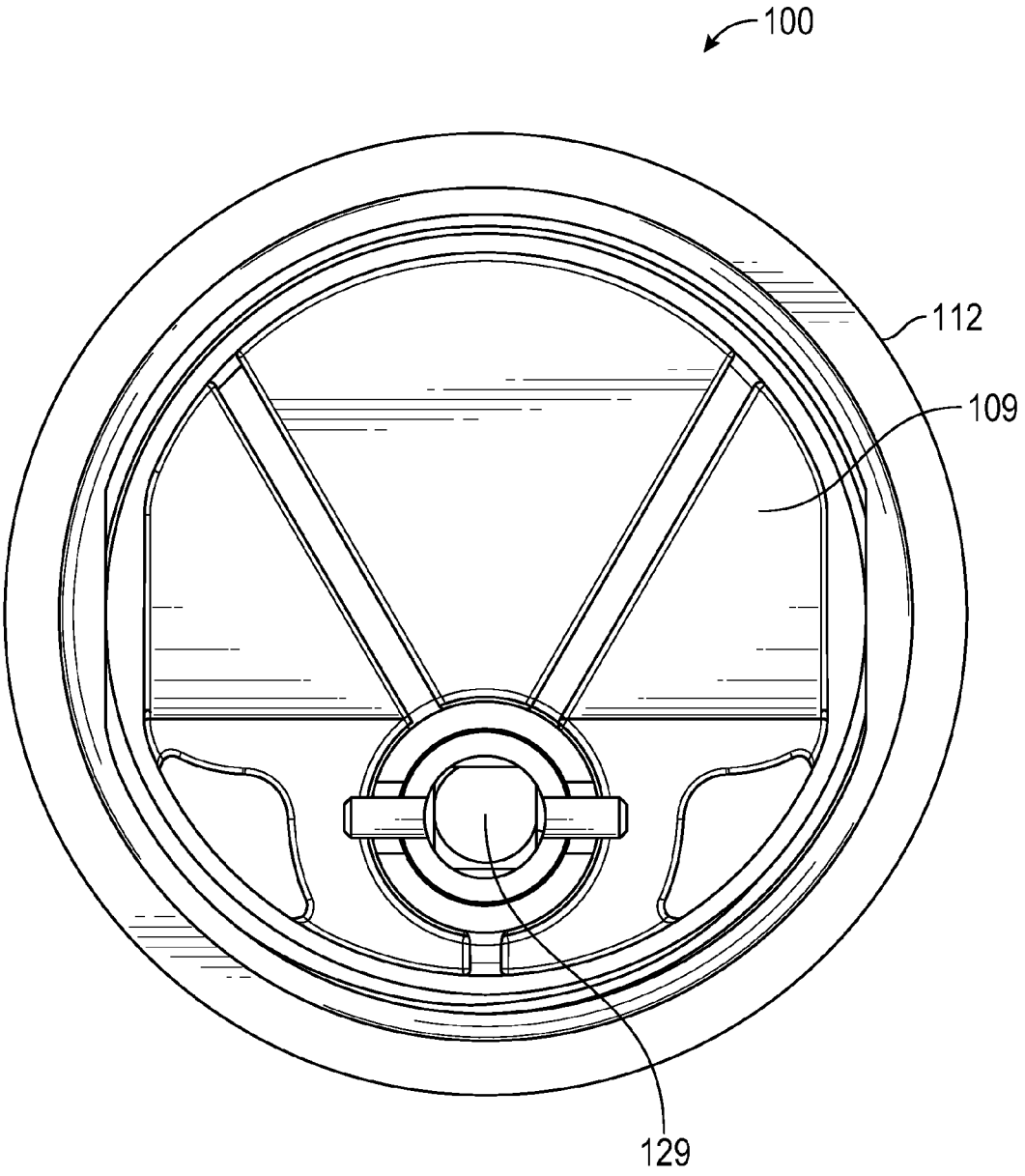
FIG. 10 is a bottom plan view of the compression latch shown in FIG. 3.
Figure 11:
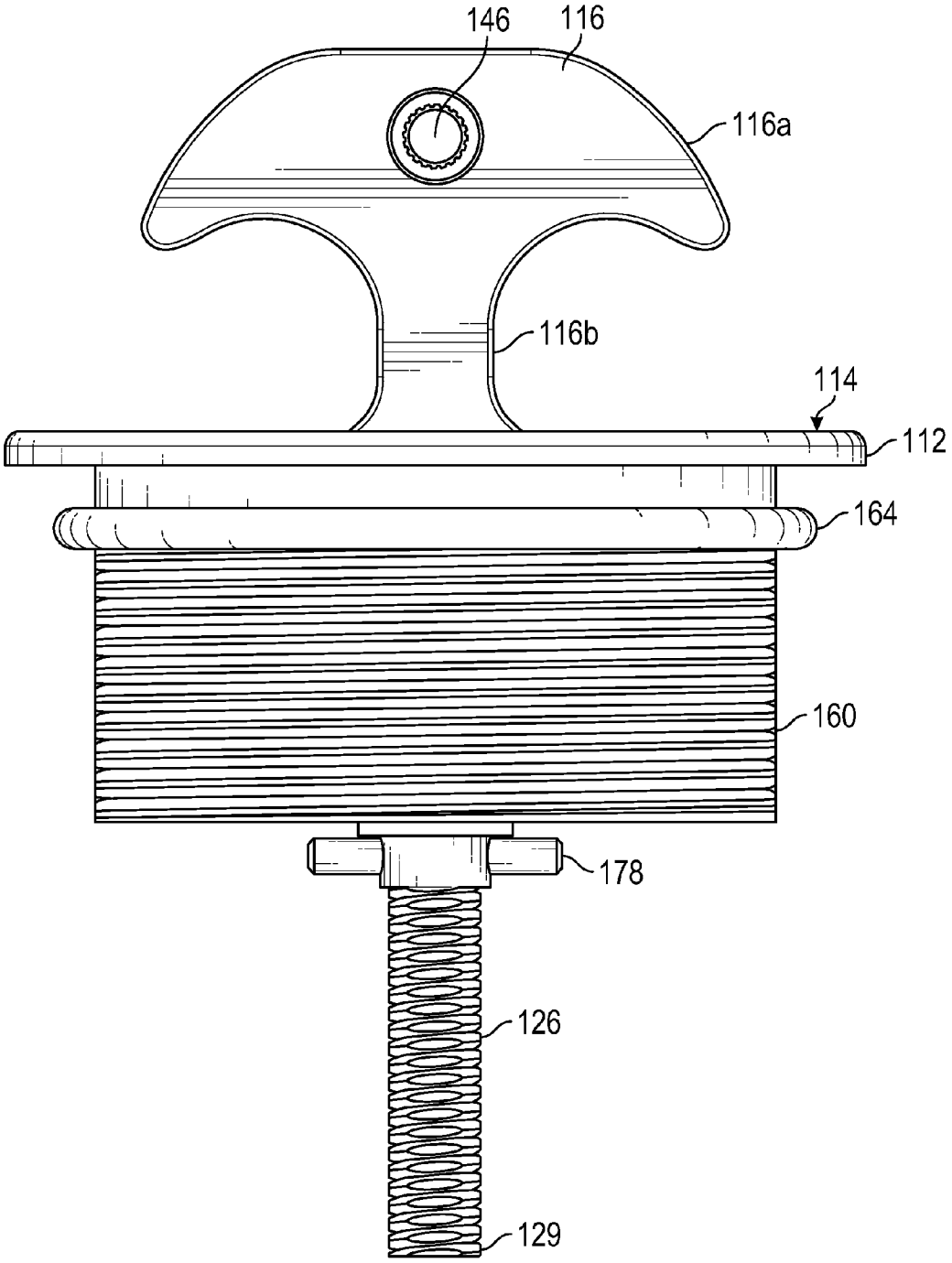
FIG. 11 is a front isometric view of the compression latch of FIG. 3, with the handle in the open position and rotated to show the locking element.
Figure 12:
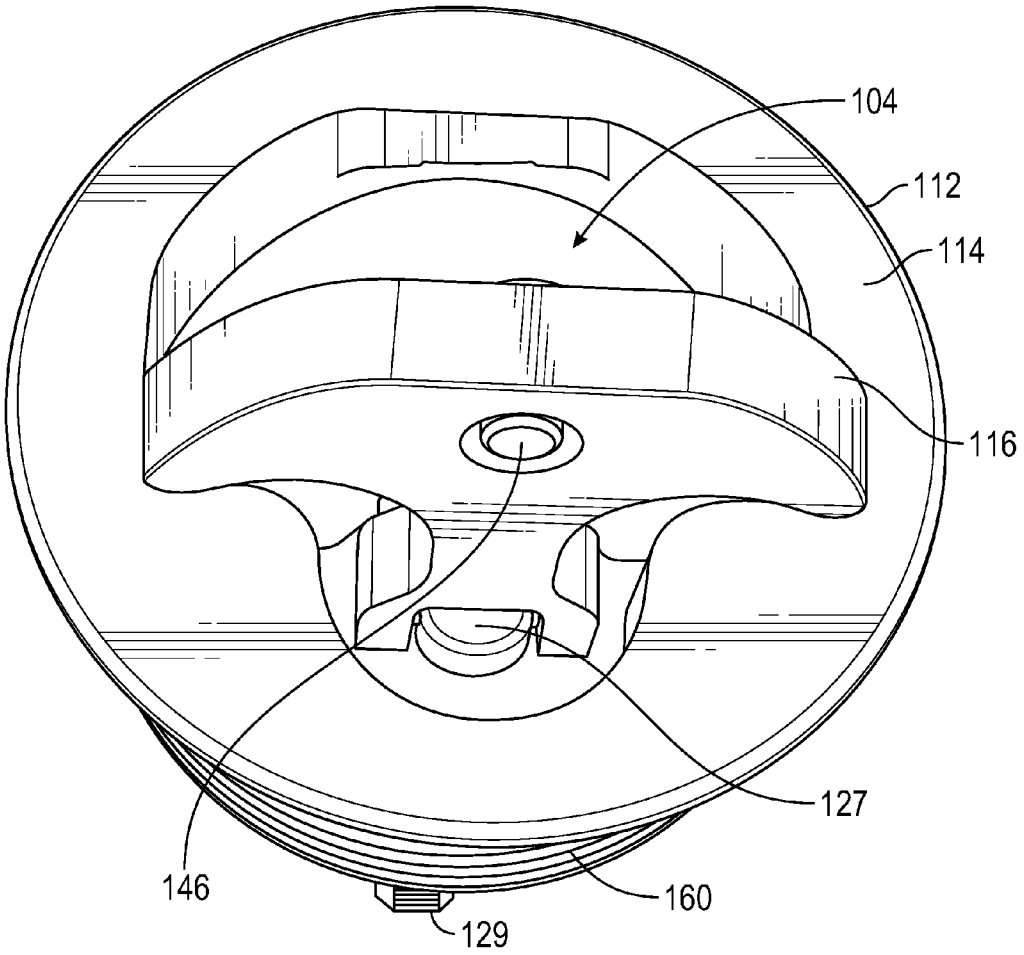
FIG. 12 is a top perspective view of the compression latch shown in FIG. 3 with the handle in the raised position.
Figure 13:
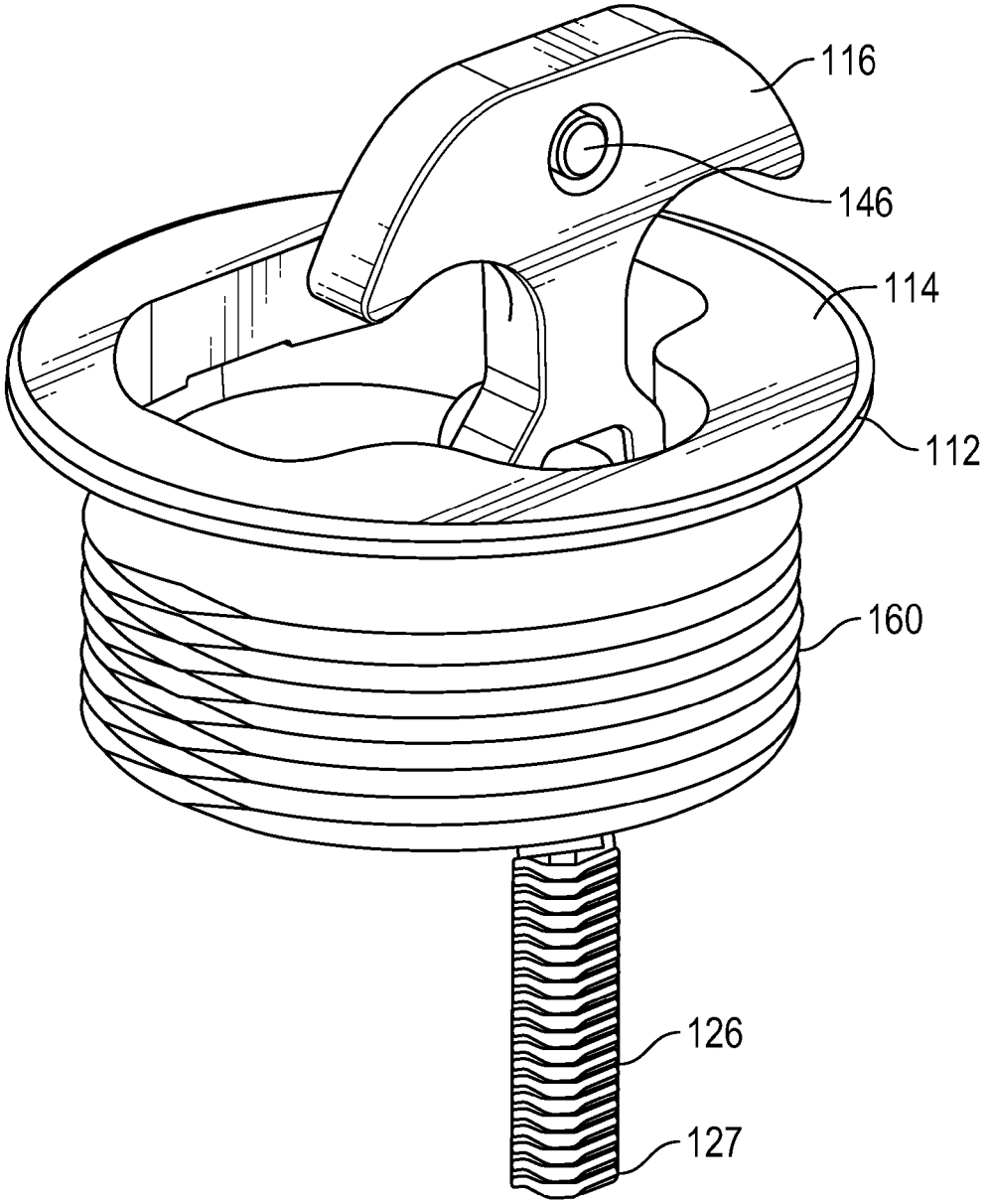
FIG. 13 is a side perspective view of the compression latch shown in FIG. 3 with the handle in the raised position.
Figure 14:
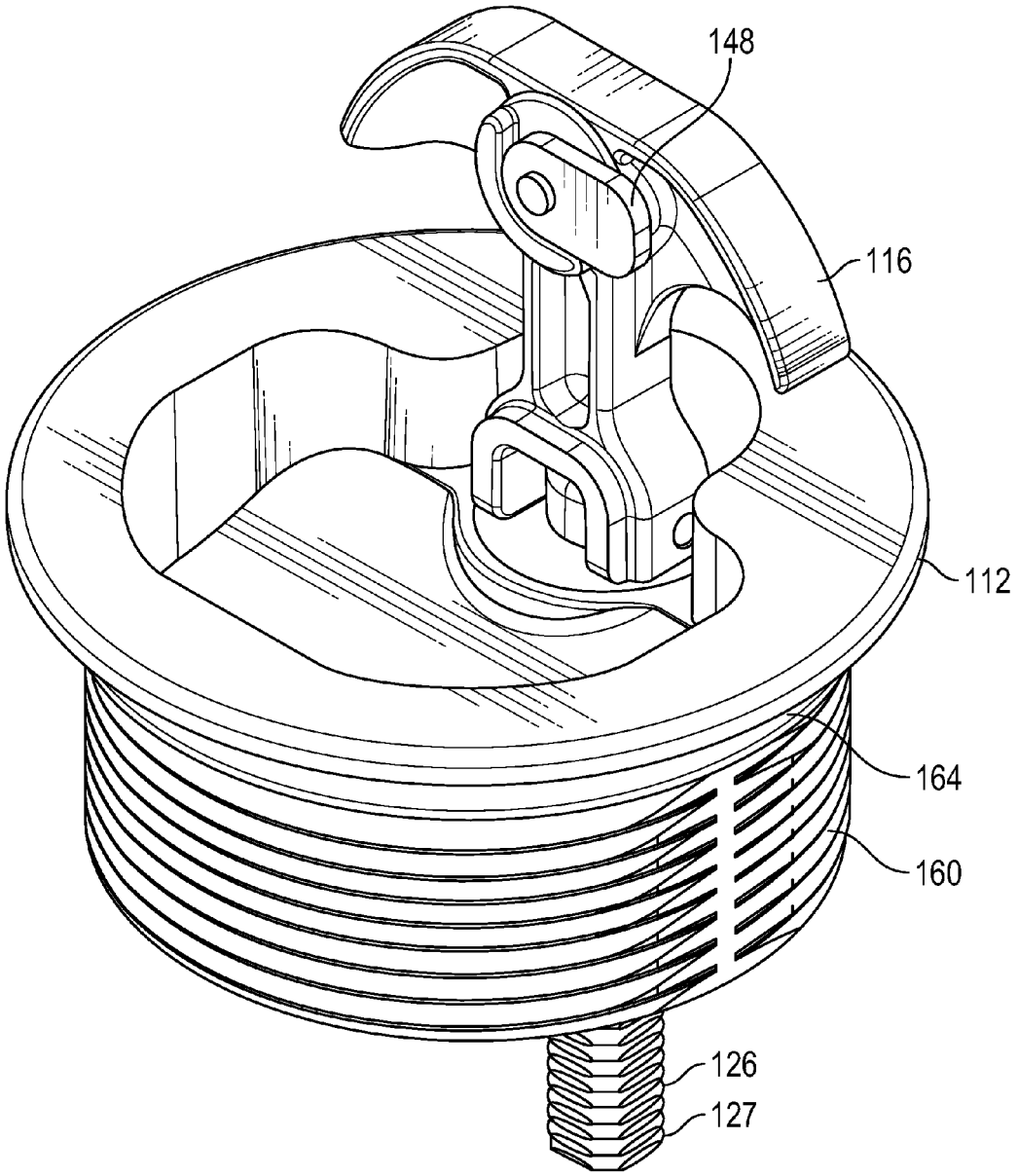
FIG. 14 is a side perspective view of the compression latch shown in FIG. 14 from the opposite side with the handle in the raised position.
Figure 15:
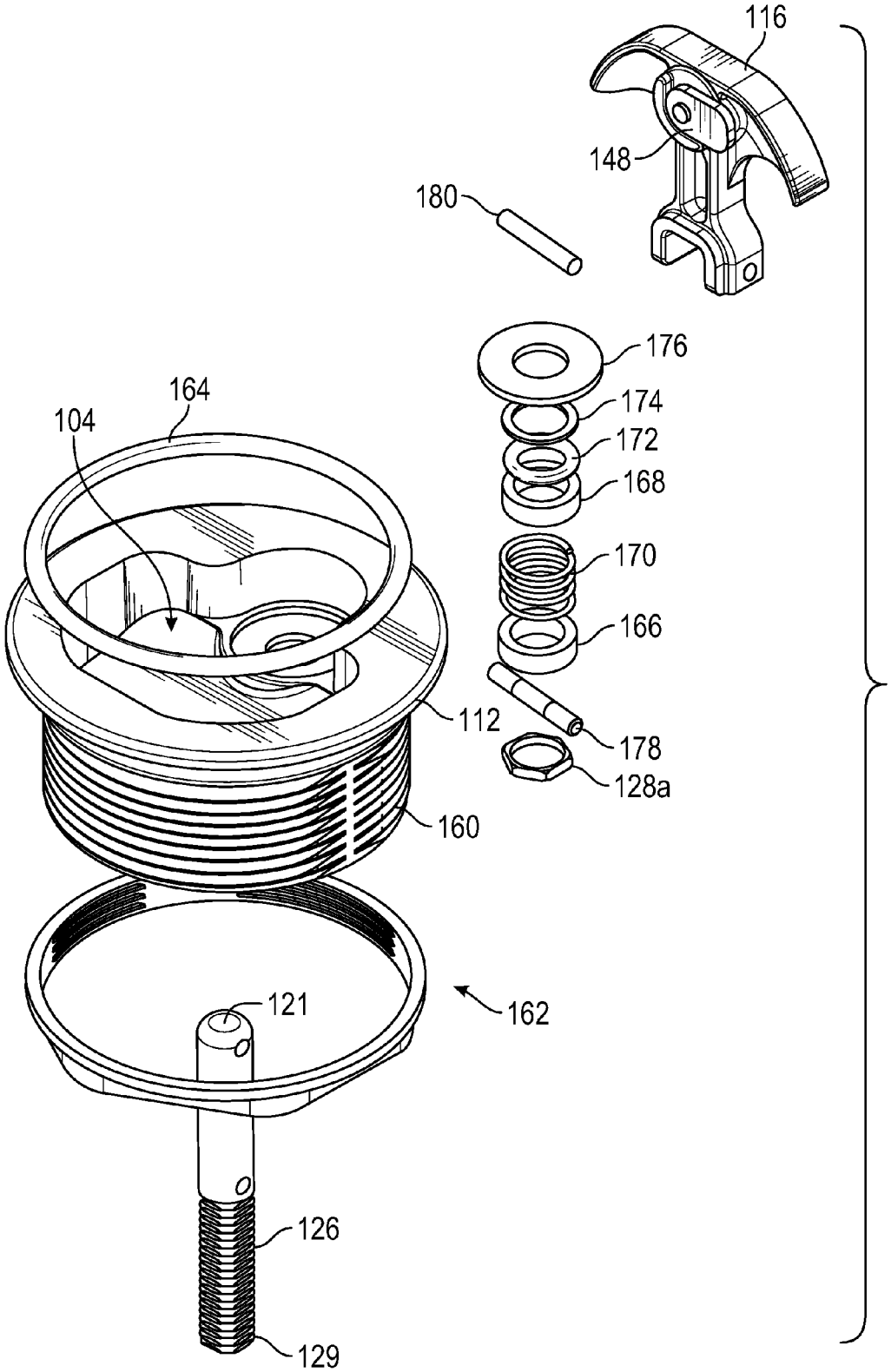
FIG. 15 is an exploded perspective view of the compression latch shown in FIG. 3.

The compression latch further 100 further comprises a cam lock 142 mounted to the T-shaped handle 116, the cam lock 142 including a base 144 with a keying element 146 connected to a rotatable locking cam 148 that secures the T-shaped handle 116 in a locked configuration when the locking cam 148 is placed in a locked position, as shown in FIGS. 7 and 8. The T-shaped handle 116 is movable from a first folded position in which the keying element 146 is exposed and flush with the uppermost surface 114 of the cup 104 to a second folded position in which the locking cam 148 is exposed and flush with the uppermost surface 114 of the cup 104, as shown in FIGS. 5 and 6. As used herein, "flush" means that the keying element does not extend past the uppermost surface 114 of the cup when the handle is in the first folded position, or the locking cam 148 does not extend past the uppermost surface 114 of the cup 104 when the handle is in the second folded position. In other words the keying element 146 does not protrude past or extend past the uppermost surface 114 when the handle is in the first folded position, or the locking cam 148 does not extend past the uppermost portion 114 of the cup 104, when the handle is in the second folded position.

In some specific embodiments, the first side 107 is a top side or exposed side that is exposed to a user of the compression latch 100 when the compression latch 100 is mounted to a hatch or door (not shown). In such embodiments, the second side 109 is a bottom side or unexposed side that faces the inside of a cabinet or compartment when the compression latch is mounted to a hatch or a door (not shown). It will be understood, of course, that in such a configuration in which the first side 107 is a top side or exposed side, the cabinet or compartment is an upwardly facing compartment, hatch or cabinet with a door that opens upwardly from the deck of a boat or other vehicle. In other embodiments, the cabinet or compartment may be mounted such that the hatch or door is generally vertically oriented to the deck of the boat or vehicle, and the first side 107 is an outer side or exposed side of the compression latch 100, and the second side 109 is an inner side or unexposed side of the compression latch facing the inside of the compartment or cabinet.

In one or more embodiments, the well 106 of the cup 104 includes a peripheral sidewall 111 including a cam lock-engaging sidewall 111*a* having an undercut 113 defining a groove 113*a* that engages the locking cam 148 when the locking cam 148 is placed in the locked position, as best shown in FIGS. 7 and 8. In some embodiments, the cam lock-engaging sidewall 111*a* has a depth "D" (shown in FIG. 8) from the uppermost surface 114 to a bottom 106*b* of the well 106 and the T-shaped handle has a thickness "t" between an inner surface 147 of the cam lock 142 and an outer surface 149 of the T-shaped handle 116, and the depth "D" is greater than the thickness "t" (shown in FIG. 9). In some embodiments, the depth "D" of the cam lock-engaging sidewall 111*a* permits the T-shaped handle 116 to be pressed beneath the uppermost surface 114.

In some embodiments, the compression latch 100 body 102 further comprises a threaded extension 160 extending from the peripheral rim 112 away from the first side 107 and a threaded nut 162 to secure the compression latch 100 to a hatch or a door (not shown). The compression latch may further comprise a gasket or an O-ring 164 disposed between the threaded nut 162 and the peripheral rim 112. In other embodiments, the compression latch 100 may comprise a backing plate and fasteners to fasten the backing plate to the second side 109 of the cup and to secure the compression latch 100 to a hatch or a door. The prior art compression latch 50 shown in FIG. 1A shows a backing plate 70 and fasteners 72, 74 suitable for this purpose. Such a backing plate 70 and fasteners 72, 74 could be used in the embodiment shown in FIGS. 2-15 as a substitute for the threaded extension 160 and the threaded nut 162. In one or more embodiments, there may be a gasket or O-ring 164 between the backing plate and the peripheral rim 112.

In some embodiments, a portion of the handle shaft 126, for example, the second end 129, is threaded, permitting the latch cam 124 to be fastened to the second end of the handle shaft by at least one threaded nut 128*a*, or a first threaded nut 128*a* and a second threaded nut 128*b*. In one or more embodiments, there is an opening 119 in the well 106 through which the handle shaft extends and an elastomeric bushing 166 disposed between the handle shaft 126 and the opening 119. There may be a second elastomeric bushing 168, as well as a spring element 170, and washers 172, 174, 176 for assembling the handle shaft 126 to the body 102. The elastomeric bushings 166, 168 assist in preventing water from going through the well and into a compartment or cabinet. Thus, the compression latch according to one or more embodiments is waterproof. A first locking pin 180 can be used to assemble the handle shaft 126 to the T-shaped handle 116, and a second locking pin 178 can be used to secure the handle shaft 126 to the body 102.

The assembly of compression latches is generally known, and it will be understood that the spring element 170 provides spring force so that the T-shaped handle 116 to be pivotally folded about the first locking pin 180 into an extended or upright position as shown in FIGS. 2-4, and to a collapsed or folded position where the T-shaped handle 116 is contained within the cup 104 or well 106. The handle shaft 126 within opening 119 permits the T-shaped handle 116 to be rotated so that the handle can be folded with the keying element 146 facing outwardly and exposed facing the first side 107, or to fold the handle into the cup 104 so that the locking cam 148 is exposed outwardly and facing the first side 107.

In one or more embodiments, the components of the compression latch 100 comprise a material selected from the group consisting of stainless steel, plastic and chrome-plated zinc. Thus, the components can be all stainless steel, all plastic, all chrome-plated zinc or combinations of these materials. In one or more embodiments, the components of the compression latch 100 comprise stainless steel, and in specific embodiments, marine grade stainless steel. In some embodiments, the T-shaped handle 116 has a third position at which the T-shaped handle 116 is upright and extends from the body 102 as shown in FIGS. 2-4.

A second embodiment pertains to a compression latch 100 which comprises a body 102 including a cup 104 having a well 106 defining a first side 107 of the compression latch 100, an exterior portion defining a second side 109 opposite the first side 107, and a raised portion defining a peripheral rim 112 surrounding the cup, the peripheral rim providing an uppermost surface 114 of the cup 104. The second embodiment further comprises a T-shaped handle 116 mounted to the body 102, the T-shaped handle 116 being foldable and reversible and having a cam lock 142 mounted thereon, the cam lock 142 having a keying element 146 on one side of the handle and a rotatable locking cam 148 on the second side of the handle, wherein when the T-shaped handle 116 is folded in a first position, the keying element 146 is exposed and does not protrude beyond the uppermost surface 114 of the cup 104 and when the T-shaped handle 116 is reversed and folded in a second position, the rotatable locking cam 148 is exposed and does not protrude beyond the uppermost surface 114 of the cup 104. Variants of the second embodiment, may include a latch cam 124 and a handle shaft 126 that rotatably connects the T-shaped handle 116 and the latch cam 124 together, the handle shaft 126 protruding through the well 104 with a first end 127 on the first side 107 and a second end 129 on the second side 109, the T-shaped handle 116 mounted on the first end, and the latch cam 124 mounted on the second end 129.

Although embodiments of the present disclosure have been described in detail hereinabove in connection with certain exemplary embodiments, it should be understood that the disclosure is not limited to the disclosed exemplary embodiments, but, on the contrary is intended to cover various modifications and/or equivalent arrangements included within the spirit and scope of the present disclosure.

Reference throughout this specification to "one embodiment," "certain embodiments," "one or more embodiments" or "an embodiment" means that a particular feature, structure, material, or characteristic described in connection with the embodiment is included in at least one embodiment of the disclosure. Thus, the appearances of the phrases such as "in one or more embodiments," "in certain embodiments," "in one embodiment" or "in an embodiment" in various places throughout this specification are not necessarily referring to the same embodiment of the disclosure. Furthermore, the particular features, structures, materials, or characteristics may be combined in any suitable manner in one or more embodiments.

Although the disclosure herein has been described with reference to particular embodiments, it is to be understood that these embodiments are merely illustrative of the principles and applications of the present disclosure. It will be apparent to those skilled in the art that various modifications and variations can be made to the method and apparatus of the present disclosure without departing from the spirit and scope of the disclosure. Thus, it is intended that the present disclosure include modifications and variations that are within the scope of the appended claims and their equivalents.

What is claimed is:

1. A compression latch comprising:

a body including a cup having a well defining a first side of the compression latch, an exterior portion defining a second side opposite the first side, and a raised portion defining a peripheral rim surrounding the cup, the peripheral rim providing an uppermost surface of the cup;

a T-shaped handle that is foldable and reversible;

a latch cam;

a handle shaft that rotatably connects the T-shaped handle and the latch cam together, the handle shaft protruding through the well with a first end on the first side and a second end on the second side, the T-shaped handle mounted on the first end, and the latch cam mounted on the second end; and a cam lock mounted to the T-shaped handle including a base with a keying element connected to a rotatable locking cam that secures the T-shaped handle in a locked configuration when the locking cam is placed in a locked position, the T-shaped handle movable from a first folded position in which the keying element is exposed and flush with the uppermost surface of the cup to a second folded position in which the locking cam is exposed and flush with the uppermost surface of the cup.

2. The compression latch of claim 1, wherein the first side is a top side that is exposed to a user of the compression latch when the compression latch is mounted to a hatch or door.

3. The compression latch of claim 1, wherein the well of the cup includes a peripheral sidewall including a cam lock-engaging sidewall having an undercut defining a groove that engages the cam lock when the cam lock is placed in the locked position.

4. The compression latch of claim 3, wherein the cam lock-engaging sidewall has a depth from the uppermost surface to a bottom of the well, and the T-shaped handle has a thickness between an inner surface of the cam lock and an outer surface of the T-shaped handle, the depth being greater than the thickness.

5. The compression latch of claim 4, wherein the depth of the cam lock-engaging sidewall permits the T-shaped handle to be pressed beneath the uppermost surface.

6. The compression latch of claim 1, the body further comprising a threaded extension extending from the peripheral rim away from the first side and a threaded nut to secure the compression latch to a hatch or a door.

7. The compression latch of claim 6, further comprising an O-ring disposed between the threaded nut and the peripheral rim.

8. The compression latch of claim 1, further comprising a backing plate and fasteners to fasten the backing plate to the second side of the cup and to secure the compression latch to a hatch or a door.

9. The compression latch of claim 8, further comprising a gasket between the backing plate and the peripheral rim.

10. The compression latch of claim 1, wherein a portion of the handle shaft is threaded permitting the latch cam to be fastened to the second end of the handle shaft by at least one threaded nut.

11. The compression latch of claim 10, further comprising an opening in the well through which the handle shaft extends and an elastomeric bushing disposed between the handle shaft and the opening.

12. The compression latch of claim 1, wherein the compression latch comprises a material selected from the group consisting of stainless steel, plastic and chrome-plated zinc.

13. The compression latch of claim 1, the T-shaped handle having a third position at which the T-shaped handle is upright and extends from the body.

14. A compression latch comprising:

a body including a cup having a well defining a first side of the compression latch, an exterior portion defining a second side opposite the first side, and a raised portion defining a peripheral rim surrounding the cup, the peripheral rim providing an uppermost surface of the cup; and a T-shaped handle mounted to the body, the T-shaped handle being foldable and reversible and having a cam lock mounted thereon, the cam lock having a keying element on one side of the handle and a rotatable locking cam on the second side of the handle, wherein when the T-shaped handle is folded in a first position, the keying element is exposed and does not protrude beyond the uppermost surface of the cup and when the T-shaped handle is reversed and folded in a second position, the rotatable locking cam is exposed and does not protrude beyond the uppermost surface of the cup.

15. The compression latch of claim 14, the T-shaped handle having a third position at which the handle is upright and extends from the body.

16. The compression latch of claim 14, further comprising:

a latch cam; and a handle shaft that rotatably connects the T-shaped handle and the latch cam together, the handle shaft protruding through the well with a first end on the first side and a second end on the second side, the T-shaped handle mounted on the first end, and the latch cam mounted on the second end.

17. The compression latch of claim 16, wherein the well of the cup includes a peripheral sidewall including a cam lock-engaging sidewall having an undercut defining a groove that engages the locking cam when the cam lock is placed in the first position.

18. The compression latch of claim 17, wherein the cam lock-engaging sidewall has a depth from the uppermost surface to a bottom of the well, and the T-shaped handle has a thickness between an inner surface of the cam lock and an outer surface of the T-shaped handle, the depth being greater than the thickness.

19. The compression latch of claim 18, wherein the depth of the cam lock-engaging sidewall permits the T-shaped handle to be pressed beneath the uppermost surface.

20. The compression latch of claim 14, the body further comprising a threaded extension extending from the peripheral rim away from the first side and a threaded nut to secure the compression latch to a hatch or a door.

* * * * *